United States Patent [19]

Palmer

[11] Patent Number: 4,676,029

[45] Date of Patent: Jun. 30, 1987

[54] OPPOSED ENDLESS BELT GRINDING APPARATUS

[75] Inventor: Raymond L. Palmer, Fen End, near Kenilworth, United Kingdom

[73] Assignee: Helical Springs Limited of Lytham Ind. Est. Park, Lancashire, United Kingdom

[21] Appl. No.: 721,292

[22] Filed: Apr. 9, 1985

[51] Int. Cl.[4] ..... B24B 21/10

[52] U.S. Cl. ..... 51/140; 51/141; 51/145 T; 51/215 AR; 51/267

[58] Field of Search ..... 51/117, 118, 137, 138, 51/140, 141, 145 T, 165.83, 165.88, 215 AR, 215 HM, 237 T, 267

[56] References Cited

U.S. PATENT DOCUMENTS

| | | | |
|---|---|---|---|
| 3,129,535 | 4/1964 | Slattery | 51/140 |
| 3,182,428 | 5/1965 | Hannon | 51/118 |
| 3,299,579 | 1/1967 | Jacobson | 51/117 X |
| 3,889,428 | 6/1975 | Steinegger et al. | 51/117 X |
| 3,909,986 | 10/1975 | Miyazawa et al. | 51/141 X |
| 4,217,734 | 8/1980 | Frei | 51/118 |

FOREIGN PATENT DOCUMENTS

| | | | |
|---|---|---|---|
| 1041678 | 10/1958 | Fed. Rep. of Germany | 51/141 |
| 2402004 | 7/1975 | Fed. Rep. of Germany | 51/140 |

*Primary Examiner*—Robert P. Olszewski
*Attorney, Agent, or Firm*—Pearson & Pearson

[57] ABSTRACT

Grinding apparatus for retaining and grinding workpieces comprises two endless abrasive belts guided to move in a direction opposed to the direction of movement of the workpieces. An angularly adjustable support biasses each abrasive belt to converge towards the direction of movement of the workpieces and the spacing of one or both abrasive belts is adjustable in response to the workpiece size. A disc having apertures therearound and rotatable so that workpieces in the apertures pass between the endless belts to grind the exposed ends of the workpieces.

6 Claims, 4 Drawing Figures

OPPOSED ENDLESS BELT GRINDING APPARATUS

BACKGROUND OF THE INVENTION

This invention relates to grinding apparatus and particularly though not exclusively to apparatus for the grinding of the ends of helical springs.

Heretofore it has been customary to sandwich grind, i.e. grind the opposed ends of a helical spring or other workpiece simultaneously, by passing the spring between two spaced, co-axial, rotating abrasive wheels. For this purpose the spring is held in a rotary magazine and is traversed about an axis lying parallel with the abrasive wheel axis into and out of the space between the two abrasive wheels, the axis of the spring also being parallel with the aforementioned axes. The material is ground from the ends of the spring progressively by reducing the spacing between the abrasive wheels. This type of arrangement has certain disadvantages. If production rates are to be maximised it is necessary for the material removal rate by the abrasive wheels to be high. In consequence, considerable heat is generated which can alter the temper and mechanical qualities of the springs. In addition the abrasive wheels are subject to considerable wear, and require frequent dressing, for example every half hour, involving machine 'down-time' and subsequent machine resetting in order to produce springs of predetermined dimensions. Replacement of excessively worn abrasive wheels is also a time consuming and therefore costly operation in terms of lost production.

SUMMARY OF THE INVENTION

It is an object of the present invention to provide apparatus for use in the grinding of the ends of springs or other workpieces, which enables high rates of material removal without heat degradation of modification of the spring or workpiece, and with which less machine down-time is required due to dressing, adjusting or replacement of grinding means than was necessary with apparatus used heretofore.

The invention provides grinding apparatus for grinding workpieces comprising holding means adapted to retain a workpiece with opposed ends thereof extending therefrom, a pair of endless abrasive belts disposed on opposed sides of said holding means, each belt having a run thereof guided in spaced relationship with said holding means along a path adjacent and diverging from a path of relative movement between said run and the holding means. Preferably a surface of each belt run opposed to an abrasive surface thereof is in contact with respective support means operable to bias said abrasive surface into contact with the respective end of a workpiece. Each support means may have a belt support which converges towards the holding means in the relative direction of motion between the holding means and the abrasive belt.

Moving means may be provided to move the holding means into a space between the two endless abrasive belts, such space being defined by a repective one run of each of the belts.

The grinding apparatus may comprise fluid supply means operable to supply cooling fluid thereto, and also may comprise a coolant clarifier operable to collect and dispose of debri cut from the workpiece.

Preferably one abrasive belt is positionally adjustable towards and away from the other, or both are adjustable, to adjust the overall length of the ground workpiece. The apparatus may comprise workpiece gauging means operable to gauge the length of a ground workpiece and to cause movement of the adjustable abrasive belt towards or away from the other in accordance with a difference in the length gauged by said gauging means and a predetermined length. Preferably said gauging means is a non-contact gauging means.

The holding means may comprise a disc shaped member having a plurality of apertures therein adjacent the periphery thereof, each aperture being adapted to retain a workpiece therein with the opposed ends thereof protruding from said aperture at opposed sides of said disc shaped member. The disc shaped member may be mounted so as to be rotatable about an axis substantially perpendicular to the direction of travel of said one runs of said abrasive belts with said periphery extending between said one runs.

BRIEF DESCRIPTION OF THE DRAWING

The invention will now be further described with reference to the accompanying drawings in which.

DESCRIPTION OF THE PREFERRED EMBODIMENTS

Figure 1:
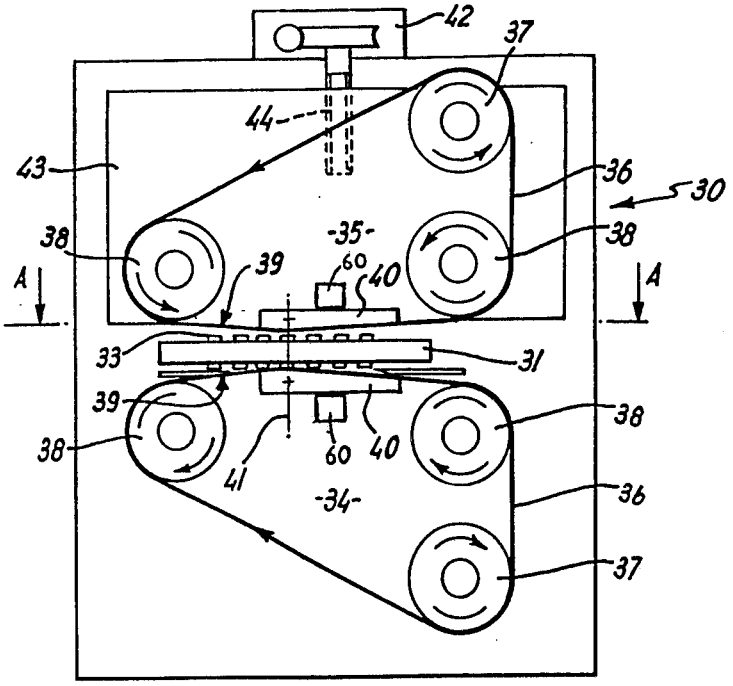
FIG. 1 is a schematic elevation of a first embodiment.
Figure 2:
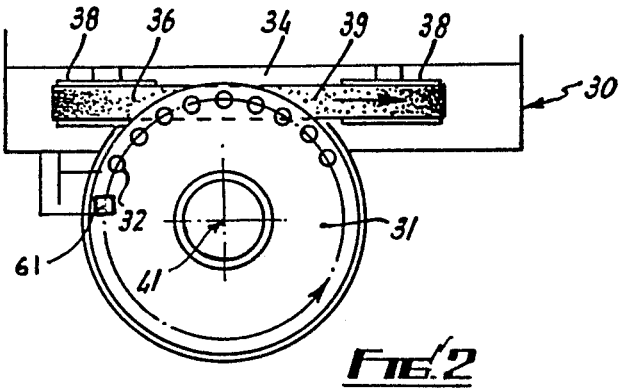
FIG. 2 is a scrap plan view on A—A of FIG. 1.
Figure 3:
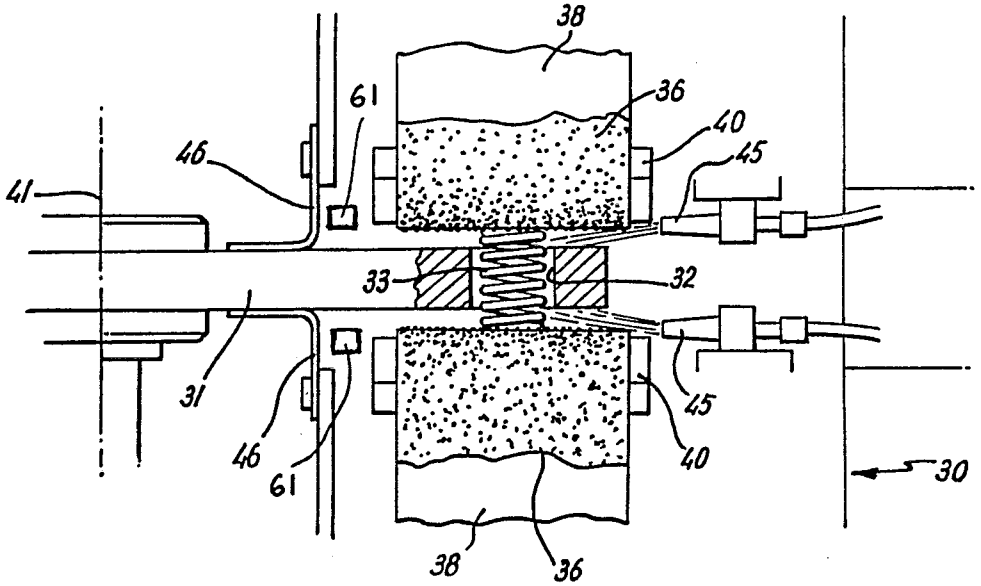
FIG. 3 is an enlarged scrap elevation of the embodiment of FIG. 1.

Referring now to FIGS. 1 to 3 there is shown a twin belt grinding machine 30. The machine 30 comprises a magazine 31 having apertures 32 in which springs or other workpieces 33 are received for grinding. The machine 30 also comprises lower and upper grinding units 34, 35 respectively, each having an endless abrasive belt 36 driven in the direction shown by the arrows by respective driving pulleys 37 and passing round two idler pulleys 38. The pulleys 38 provide substantially horizontal runs 39 of the belts 36, each of which passes in contact with a respective supporting platen 40. The magazine 31 is mounted in the machine 30 for rotation in the direction shown by the arrow about a vertical axis 41 laterally spaced from the plane of movement of belts 36 so that the springs 33 pass in succession into the space between the runs 39 of belts 36. The lower grinding unit 34 is fixed in the machine 30 whereas the upper grinding unit 35 is mounted on a slide 43 which is movable vertically by means of control unit 42 so as to adjust the relative spacing of runs 39 of belts 36 for differing required machined lengths of springs 33. The control unit 42 comprises a ball screw 44 and DC electric servo-motor (not shown) equipped with a positional feed back transducer to determine the machined length of springs 33. A non-contact gauging device 61 of only conventional type may be coupled to the servo-motor to adjust the position of grinding unit 35 to provide the desired machined length of springs 33. The speed of rotation of magazine 31 may be varied to adjust the rate of feed of springs 33 between the belt runs 39. The guide platens 40 have belt-contacting faces converging in the direction of feed of the springs 33 so that material is progressively ground from the ends of each spring 33 as it is fed between the belts 36. The angular disposition of the guide platens 40 relative to each other may be varied by adjustment means 60 of any conventional type to vary the angle of convergence and thereby control the rate of progressive depth of grinding cut applied to the springs 33. As shown in FIG. 3 the belt-contacting, converging surface of guide platens 40 are flat, but alternative profiles of platen may be used if desired. These surfaces are hardened to prevent pick up of abrasive belt backing material and have radiussed leading and trailing edges. The idler pulley 38 disposed between the drive pulley 37 and the run 39 of each belt is positionally adjustable on the respective grinding unit 34 or 35 by hydraulic means (not shown) so as to tension the abrasive belt 36. In addition the provision of three pulleys 37, 38, 38 for each belt 36 enables a longer belt 36 to be used in comparison with a two-pulley arrangement.

In this way the life of belt 36 is prolonged, it runs at a lower temperature and is less prone to becoming "clogged" with material cut from springs 33 than with a two pulley arrangement. The grinding belts 36 are driven by an electric motor (not shown).

To exploit the high metal removal rate possible with the machine 30 it is provided with means for supplying coolant fluid to the grinding region. This prevents or substantially reduces the generation of heat which could alter the temper and mechanical qualities of the ground springs whilst enabling high feed rates of springs through the machine. As shown in FIG. 3 coolant nozzles 45 are mounted on the respective grinding unit 34, 35 to supply coolant fluid at the level of each abrasive belt run 39 in the grinding region. To maintain the coolant fluid in the grinding region resiliently flexible curtains 46, preferably of rubber, are provided on each grinding unit 34, 35 around this region, the curtains 46 overlapping to sufficient an extent to provide an effective shield throughout the range of vertical adjustment of grinding unit 35. At the locations of entry to and exit from the grinding region of the springs 33 in the magazine 31 the curtains 46 may be cut into strips or brushes or other suitable space sealing means may be provided.

The machine 30 may be provided with a coolant clarifier pumping system (not shown) which automatically collects and disposes of the metal debris in a chute remote from the machine 30.

Figure 4:
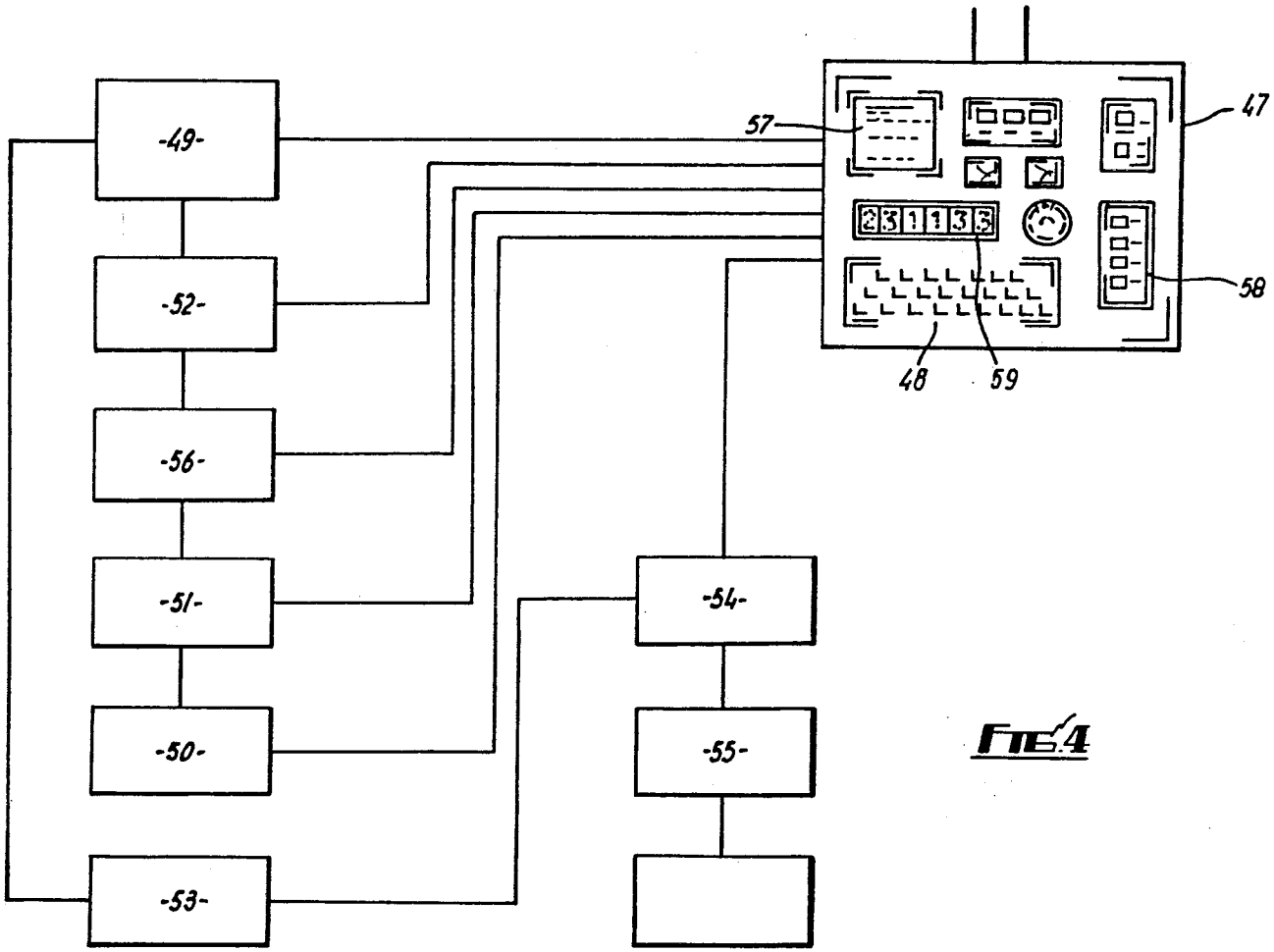
FIG. 4 is a schematic diagram of the control system of the embodiment of FIG. 1.

A suitable control system for the machine 30 is shown diagrammatically in FIG. 4. The microprocessor control unit 47 is programmed to control the motors of machine 30 in response to instructions entered therein on keyboard 48. Controllable items are machine on/off 49, magazine rotational speed 50 and position 51, positional adjustment 52 of support platens 40, belt tensioning 53, belt drive on/off 54 and speed 55 and non-contact gauge setting 56. Data relating to the abovementioned items may be displayed on screen 57 or presented digitally at 58. The machined spring size as determined by the gauge is displayed digitally at 59 and can be compared with the gauge setting information supplied to the control unit 47. Other controls incorporated into the control system may be; abrasive belt drive initiated before magazine drive initiated; abrasive belt speed and support platen position adjusted in accordance with data relative to the type of spring being ground; automatic upward movement of slide 43 if non-standard operation of machine 30 occurs; coolant fluid feed rate dependent upon the prevailing grinding conditions and push-button override of the automatic operation of the machine if required.

By means of the invention the production rate of the sandwich grinding of springs or the like workpieces may be increased by a factor of up to 30 by comparison with the twin abrasive wheel machines presently used. In addition the cost of grinding the workpieces can be reduced by a factor of up to 12. A further advantage of the machine of the present invention lies in the aspect of machine down-time, it taking approximately 5 minutes to change the abrasive belts when worn or damaged and approximately 2½ hours to change worn or damaged abrasive wheels. Furthermore the frequent dressing of the abrasive wheels and readjustment of the machine necessary with the twin abrasive wheel machines is avoided.

The apparatus described herein has the springs disposed vertically and travelling in a horizontal plane to be ground, the belt or belts lying in a vertical plane. If desired the springs may be mounted so as to be disposed horizontally and to travel in a vertical plane to be ground.

Workpieces other than springs may be ground with the apparatus herein described, particularly if such other workpieces are to be duplex or sandwich ground to accurate dimensions.

In the apparatus of FIGS. 1 to 3 both of the abrasive belts 36 may be movable towards or away from each other if desired, i.e. the lower grinding unit 34 may have a position control unit 42 associated therewith. Also the movement of one or both grinding units may be controlled by a cam device instead of the ball screw as hereinbefore described.

I claim:

1. Grinding apparatus for grinding workpieces comprising holding means having opposed sides and adapted to retain a workpiece having opposed ends with said opposed ends extending therefrom at said opposed sides, a pair of endless abrasive belts disposed on said opposed sides of said holding means, each belt having a run thereof, a grinding surface and a surface opposed thereto means operable to move one of said holding means and said belt runs along a path of relative movement therebetween, each belt run being guided in spaced relationship with said holding means to define an elongate grinding zone between said belts, said belts being guided by respective support means disposed to contact each belt along said opposed surface thereof over the length of said grinding zone and to guide said grinding surface into contact with a respective end of a workpiece when retained in said holding means, each support means having a belt support surface which converges toward said holding means in the direction of relative motion between said holding means and the respective abrasive belt, whereby each of said belts is guided to move along a path adjacent and diverging from said holding means in said grinding zone.

2. Grinding apparatus according to claim 1, comprising adjustment means wherein the angle of convergence of said belt support surface to said holding means is adjustable.

3. Grinding apparatus according to claim 1 comprising fluid supply means operable to supply a cooling fluid to the grinding region.

4. Grinding apparatus according to claim 1, wherein at least one of said belts is positionally adjustable towards and away from the other of said belts.

5. Grinding apparatus according to claim 4 comprising workpiece gauging means operable to gauge the length of a ground workpiece.

6. Grinding apparatus according to claim 5, wherein said workpiece gauging means is operable to cause movement of each positionally adjustable belt relative to the other of said belts in accordance with a difference in a gauged length of a workpiece gauged by said gauging means and a predetermined length.

* * * * *